US011373596B2

(12) United States Patent
Wang et al.

(10) Patent No.: US 11,373,596 B2
(45) Date of Patent: Jun. 28, 2022

(54) PIXEL CIRCUIT AND DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Jun Wang, Beijing (CN); Zhonghao Huang, Beijing (CN); Yongliang Zhao, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 214 days.

(21) Appl. No.: 16/622,547

(22) PCT Filed: Jun. 13, 2019

(86) PCT No.: PCT/CN2019/091075
§ 371 (c)(1),
(2) Date: Dec. 13, 2019

(87) PCT Pub. No.: WO2019/242557
PCT Pub. Date: Dec. 26, 2019

(65) Prior Publication Data

US 2021/0335260 A1 Oct. 28, 2021

(30) Foreign Application Priority Data

Jun. 21, 2018 (CN) ..... 201810645427.5

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC ..... G09G 3/3258; G09G 3/3233; G09G 2300/0426; G09G 2300/0842; G09G 2320/0219; G09G 2320/0233
(Continued)

(56) References Cited

U.S. PATENT DOCUMENTS 7,009,591 B2 3/2006 Shibusawa
7,652,649 B2 1/2010 Huang
(Continued)

FOREIGN PATENT DOCUMENTS

CN 1652185 A 8/2005
CN 1698087 A 11/2005
(Continued)

OTHER PUBLICATIONS

Office Action dated Sep. 3, 2019 issued in corresponding Chinese Application No. 201810645427.5.
(Continued)

*Primary Examiner* — Tom V Sheng
(74) *Attorney, Agent, or Firm* — Nath, Goldberg & Meyer; Joshua B. Goldberg

(57) ABSTRACT

A pixel circuit and a display device are provided. The pixel circuit includes: a driving transistor; a switching transistor for transmitting a data voltage signal to a first electrode of the driving transistor; a storage capacitor having a first terminal coupled to a control electrode of the driving transistor, and a second terminal coupled to a reference voltage
(Continued)

terminal; a threshold voltage extraction unit for coupling the control electrode of the driving transistor to a second electrode of the driving transistor through the scan signal; a light emission control unit for transmitting a second power voltage to the first electrode of the driving transistor; a light emitting device having a first electrode coupled to a second electrode of the driving transistor and a second electrode receiving a first power voltage; a compensation unit for transmitting a compensation voltage to a second electrode of the switching transistor.

19 Claims, 4 Drawing Sheets

(52) U.S. Cl.
CPC ..... *G09G 2300/0842* (2013.01); *G09G 2320/0219* (2013.01); *G09G 2320/0233* (2013.01)

(58) Field of Classification Search
USPC ..... 345/212
See application file for complete search history.

(56) References Cited

U.S. PATENT DOCUMENTS

| | | | | |
|---|---|---|---|---|
| 10,373,557 | B2 | 8/2019 | Zhu et al. | |
| 10,431,153 | B2 * | 10/2019 | Gao | G09G 3/3233 |
| 10,621,922 | B2 | 4/2020 | Oh et al. | |
| 2004/0056604 | A1 * | 3/2004 | Shih | G09G 3/3241 315/169.2 |
| 2005/0007307 | A1 * | 1/2005 | Aoki | G09G 3/3233 345/55 |
| 2008/0174583 | A1 * | 7/2008 | Lee | G09G 3/3688 345/211 |
| 2009/0225012 | A1 | 9/2009 | Choi | |
| 2010/0007651 | A1 * | 1/2010 | Kim | G09G 3/3233 345/213 |
| 2010/0194716 | A1 * | 8/2010 | Park | G09G 3/3233 345/204 |
| 2011/0148855 | A1 | 6/2011 | Kim et al. | |
| 2012/0274615 | A1 * | 11/2012 | Ochi | G09G 3/3233 345/204 |
| 2013/0257839 | A1 | 10/2013 | Hyeon et al. | |
| 2015/0138181 | A1 | 5/2015 | Hwang | |
| 2016/0284276 | A1 * | 9/2016 | Gupta | G09G 3/3225 |
| 2019/0096322 | A1 | 3/2019 | Gao | |
| 2019/0114960 | A1 * | 4/2019 | Lee | G09G 3/3233 |

FOREIGN PATENT DOCUMENTS

| | | | |
|---|---|---|---|
| CN | 1804710 | A | 7/2006 |
| CN | 104409042 | A | 3/2015 |
| CN | 104715714 | A | 6/2015 |
| CN | 106558287 | A | 4/2017 |
| CN | 106971697 | A | 7/2017 |
| CN | 107274830 | A | 10/2017 |
| CN | 107424564 | A | 12/2017 |
| CN | 107644619 | A | 1/2018 |
| CN | 107767819 | A | 3/2018 |
| CN | 108172173 | A | 6/2018 |
| CN | 108777130 | A | 11/2018 |

OTHER PUBLICATIONS

Office Action dated May 28, 2020 issued in corresponding Chinese Application No. 201810645427.5.

* cited by examiner

PIXEL CIRCUIT AND DISPLAY DEVICE

CROSS REFERENCE TO RELATED APPLICATIONS

The present application is a U.S. National Stage Application under 35 U.S.C. § 371 of International Patent Application No. PCT/CN2019/091075, filed on Jun. 13, 2019, which claims priority to China Patent Application No. 201810645427.5, filed on Jun. 21, 2018 the disclosure of both which are incorporated by reference herein in entirety.

TECHNICAL FIELD

The disclosure relates to the field of display technology, and particularly relates to a pixel circuit and a display device.

BACKGROUND

With the development of display technology, organic light emitting diodes (OLEDs) are increasingly used in high performance display fields due to their characteristics such as self-luminescence, fast response, wide viewing angle, and being capable of being fabricated on a flexible substrate.

An OLED display panel generally includes a plurality of pixels arranged in a matrix, and driving and controlling each pixel to display depends on a pixel circuit in the pixel. The pixel circuit mainly includes a switching transistor, a capacitor, and a light emitting device OLED.

SUMMARY

An embodiment of the present disclosure provides a pixel circuit including a switching transistor, a driving transistor, a storage capacitor, a threshold voltage extraction unit, a light emission control unit, a light emitting device, and a compensation unit. The light emitting device has a first electrode coupled to a second electrode of the driving transistor and a second electrode receiving a first power voltage. A first terminal of the storage capacitor is coupled to a control electrode of the driving transistor, a second terminal of the storage capacitor is coupled to a reference voltage terminal. The switching transistor is configured to transmit a data voltage signal to a first electrode of the driving transistor under the control of a scan signal. The threshold voltage extracting unit is configured to couple a control electrode of the driving transistor to the second electrode of the driving transistor under the control of the scan signal. The light emission control unit is configured to transmit a second power voltage to the first electrode of the driving transistor under the control of a light emission control signal. The compensation unit is configured to transmit a compensation voltage to a second electrode of the switching transistor to reduce a feedthrough voltage of the switching transistor.

In some embodiments, the compensation unit includes a compensation capacitor, a first terminal of the compensation capacitor is coupled to the second electrode of the switching transistor, a second terminal of the compensation capacitor is coupled to a compensation voltage terminal, and the compensation voltage terminal provides the compensation voltage.

In some embodiments, the pixel circuit further includes a reset unit configured to transmit an initialization signal to the control electrode of the driving transistor under the control of a reset control signal.

In some embodiments, the reset unit includes a reset transistor. A first electrode of the reset transistor is coupled to an initialization signal terminal, a second electrode of the reset transistor is coupled to the control electrode of the driving transistor, a control electrode of the reset transistor is coupled to a reset signal terminal, the initialization signal terminal provides the initialization signal, and the reset signal terminal provides the reset control signal.

In some embodiments, the first terminal of the compensation capacitor is coupled to the second electrode of the switching transistor and the first electrode of the driving transistor, the second terminal of the compensation capacitor is coupled to the initialization signal terminal, and the initialization signal terminal is used as the compensation voltage terminal.

In some embodiments, the first terminal of the compensation capacitor is coupled to the second electrode of the switching transistor and the first electrode of the driving transistor, the second terminal of the compensation capacitor is coupled to the reset signal terminal, and the reset signal terminal is used as the compensation voltage terminal.

In some embodiments, the light emission control unit includes a first light emission control transistor. A first electrode of the first light emission control transistor is coupled to a second power voltage terminal, a second electrode of the first light emission control transistor is coupled to the second electrode of the switching transistor, the first electrode of the driving transistor and the first terminal of the compensation capacitor, a control electrode of the first light emission control transistor is coupled to a light emission control signal terminal, and the light emission control signal terminal provides the light emission control signal.

In some embodiments, the first terminal of the compensation capacitor is coupled to the second electrode of the switching transistor, the second terminal of the compensation capacitor is coupled to the second power voltage terminal, and the second power voltage terminal provides the second power voltage and is common to the compensation voltage terminal.

In some embodiments, the light emission control unit further includes a second light emission control transistor. A first electrode of the second light emission control transistor is coupled to the threshold voltage extraction unit and the second electrode of the driving transistor, a second electrode of the second light emission control transistor is coupled to the first electrode of the light emitting device, and a control electrode of the second light emission control transistor is coupled to the light emission control signal terminal.

In some embodiments, the threshold voltage extracting unit includes a threshold voltage extraction transistor. A first electrode of the threshold voltage extraction transistor is coupled to the first terminal of the storage capacitor and the control electrode of the driving transistor, a second electrode of the threshold voltage extraction transistor is coupled to the second electrode of the driving transistor and the first electrode of the light emitting device, the control electrode of the threshold voltage extraction transistor is coupled to a scan line, and the scan line provides the scan signal.

In some embodiments, the first terminal of the storage capacitor is coupled to the control electrode of the driving transistor and the threshold voltage extraction unit, and the second terminal of the storage capacitor is coupled to a second power voltage terminal which supplies the second power voltage and is common to the reference voltage terminal.

In some embodiments, a first electrode of the switching transistor is coupled to a data line, the second electrode of the switching transistor is coupled to a first terminal of the compensation unit, the first electrode of the driving transistor and the light emission control unit, a control electrode of the switching transistor is coupled to a scan line, the data line provides the data voltage signal, and the scan line provides the scan signal.

In some embodiments, the first electrode of the driving transistor is coupled to the light emission control unit, a first terminal of the compensation unit and the second electrode of the switching transistor, the second electrode of the driving transistor is coupled to the threshold voltage extraction unit and the first electrode of the light emitting device, and the control electrode of the driving transistor is coupled to the first terminal of the storage capacitor and the threshold voltage extraction unit.

An embodiment of the present disclosure further provides a display device, which includes the above pixel circuit.

DETAILED DESCRIPTION

In order to make the technical solutions of the present disclosure better understood by those skilled in the art, the technical solutions of the present disclosure are further described in detail below with reference to the accompanying drawings and embodiments.

Transistors used in the embodiments of the present disclosure may be thin film transistors, field effect transistors, or other devices with the same characteristics. Since a source and a drain of a transistor are interchangeable under a certain condition, there is no difference in descriptions of the couplings of the source and the drain of the transistor. In the embodiments of the present disclosure, in order to distinguish the source and the drain of the transistor, one of the source and the drain of the transistor is referred to as a first electrode, the other one of the source and the drain of the transistor is referred to as a second electrode, and a gate of the transistor is referred to as a control electrode. In addition, the transistors can be classified into N-type transistors and P-type transistors according to their characteristics. The following embodiments will be described by taking P-type transistors as an example. When a P-type transistor is used, a first electrode of the P-type transistor may be the source of the P-type transistor, a second electrode of the P-type transistor may be the drain of the P-type transistor, and the source and the drain of the P-type transistor are electrically coupled together when the gate (i.e., the control electrode) of the P-type transistor is applied with a low level. It should be understood that technical solutions for implementing the embodiments of the present disclosure with N-type transistors can be easily conceived by those skilled in the art without inventive efforts. For an N-type transistor, when a high level is input to the gate (i.e., the control electrode) of the N-type transistor, the source and the drain of the N-type transistor are electrically coupled together.

Figure 1:
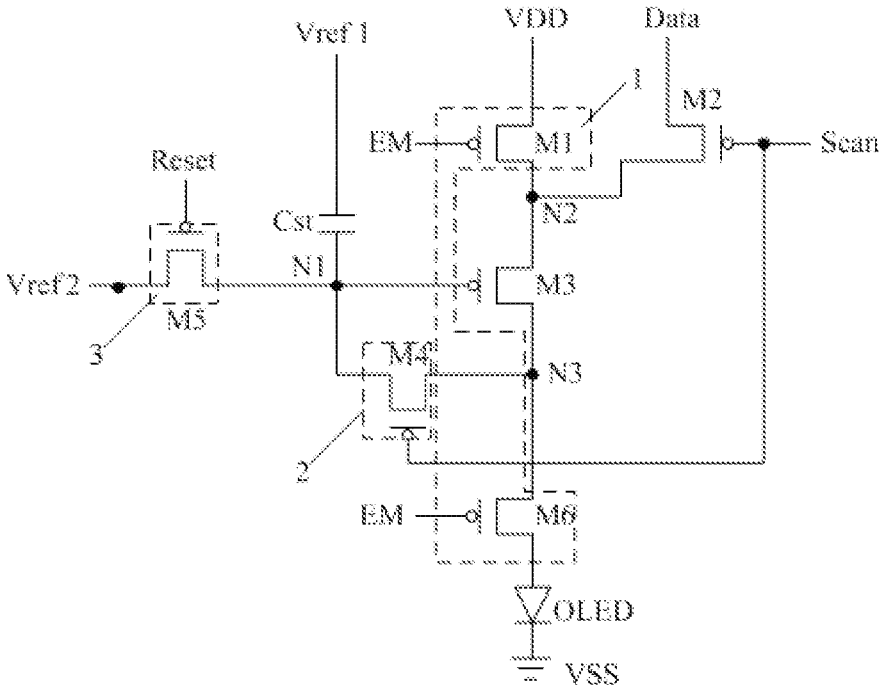
FIG. 1 is a schematic diagram showing a structure of a pixel circuit.

FIG. 1 shows a schematic diagram of a structure of a pixel circuit. As shown in FIG. 1, the pixel circuit includes a light emitting device OLED, a light emission control unit 1, a threshold voltage extraction unit 2, a reset unit 3, a switching transistor M2, a driving transistor M3, and a storage capacitor Cst. The switching transistor M2 is turned on under the control of a scan signal on a scan line Scan to transmit a data voltage signal on a data line Data to a first electrode of the driving transistor M3, however, since the scan signals for controlling the switching transistor M2 to be turned on and off are different, for example, when the switching transistor M2 is a P-type transistor, the scan signal for controlling the switching transistor M2 to be turned on is at a low level, and the scan signal for controlling the switching transistor M2 to be turned off is at a high level, a parasitic capacitance is generated between a second electrode and a control electrode of the switching transistor M2 during the process of switching the scan signal between the high level and the low level, so that a feedthrough voltage is generated at the second electrode of the switching transistor M2. At the same time, since the switching transistors M2 in the pixel circuits in a same row in the display panel are usually coupled to a same scan line Scan, and the scan line Scan has a resistance, therefore, a voltage of a scan signal of a switching transistor M2 of a pixel circuit distal to the scan signal input terminal of the scan line Scan is lower than a voltage of a scan signal of a switching transistor M2 of the pixel circuit proximal to the scan signal input terminal of the scan line Scan due to the resistance of the scan line Scan, so that, in the process of switching the scan signal between the high level and the low level, magnitudes of the parasitic capacitances generated between the second electrodes and the control electrodes of the switching transistors M2, which are at different positions, in the pixel circuits of a same row are different, that is, the feedthrough voltages generated at the second electrodes of the switching transistors M2, which are at different positions, in the pixel circuits of the same row are different, resulting in non-uniform display of the display panel.

Figure 2:
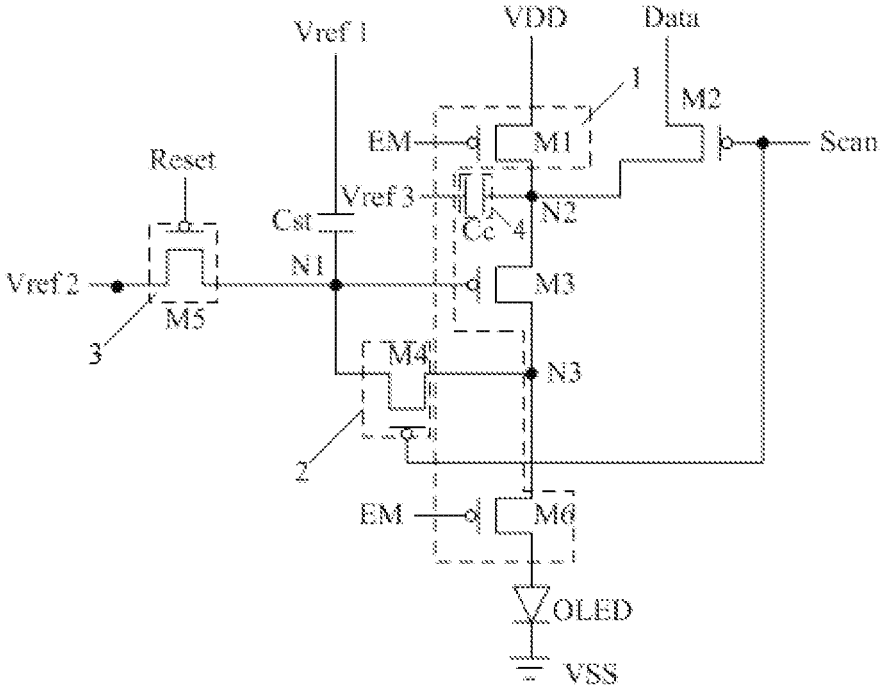
FIG. 2 is a schematic diagram showing a structure of a pixel circuit according to an embodiment of the disclosure.

FIG. 2 shows a schematic diagram of a structure of a pixel circuit according to an embodiment of the present disclosure. As shown in FIG. 2, the pixel circuit of the embodiment of the present disclosure includes a light emitting device OLED, a light emission control unit 1, a threshold voltage extraction unit 2, a reset unit 3, a switching transistor M2, a driving transistor M3, a storage capacitor Cst, and a compensation unit 4. The light emitting device MED has a first electrode coupled to a drain of the driving transistor M3, and a second electrode receiving a first power voltage. A first terminal of the storage capacitor Cst is coupled to a gate of the driving transistor M3, and a second terminal of the storage capacitor Cst is coupled to a reference voltage terminal Vref1. The switching transistor M2 transmits a data voltage signal on a data line Data to a source of the driving transistor M3 under the control of a scan signal on a scan line Scan. The threshold voltage extraction unit 2 is configured to electrically couple the gate and a drain of the driving transistor M3 under the control of the scan signal on the scan line Scan. The light emission control unit 1 transmits, under the control of a light emission control signal supplied from a light emission control signal terminal EM, a second power voltage supplied from a second power voltage terminal VDD to the source of the driving transistor M3 to drive the light emitting device MED to emit light. The compensation unit 4 is configured to transmit a compensation voltage provided by a compensation voltage terminal Vref3 to a drain of the switching transistor M2 to reduce the feedthrough voltage of the switching transistor M2.

Since the compensation unit 4 is added to the pixel circuit of the present embodiment, and the compensation unit 4 can reduce the feedthrough voltage generated by the switching transistor M2 by using the compensation voltage, in this way, in the display panel to which the pixel circuit of the present embodiment is applied, the feedthrough voltage of the switching transistor M2 in each pixel circuit is reduced, so that the difference between the feedthrough voltages of the switching transistors M2 at different positions can be greatly reduced, and the problem of display non-uniformity of the display panel can be effectively improved.

In the pixel circuit of the present embodiment, the compensation unit 4 may include a compensation capacitor Cc. A first terminal of the compensation capacitor Cc is coupled to the drain of the switching transistor M2, and a second terminal of the compensation capacitor Cc is coupled to the compensation voltage terminal Vref3. The compensation voltage terminal Vref3 is configured to provide the compensation voltage. Certainly, the compensation unit 4 is not limited to including only the compensation capacitor Cc. According to the capacitance formula $C=\varepsilon\times\varepsilon_0\times S/d$, where $\varepsilon$ is a dielectric constant of a material of an insulating layer of the capacitor, $\varepsilon_0$ is a vacuum dielectric constant, S is an area of the capacitor, and d is a thickness of the insulating layer of the capacitor. $\varepsilon$, $\varepsilon_0$, S and d may be adjusted to determine a magnitude of the compensation capacitor Cc.

Figure 3:
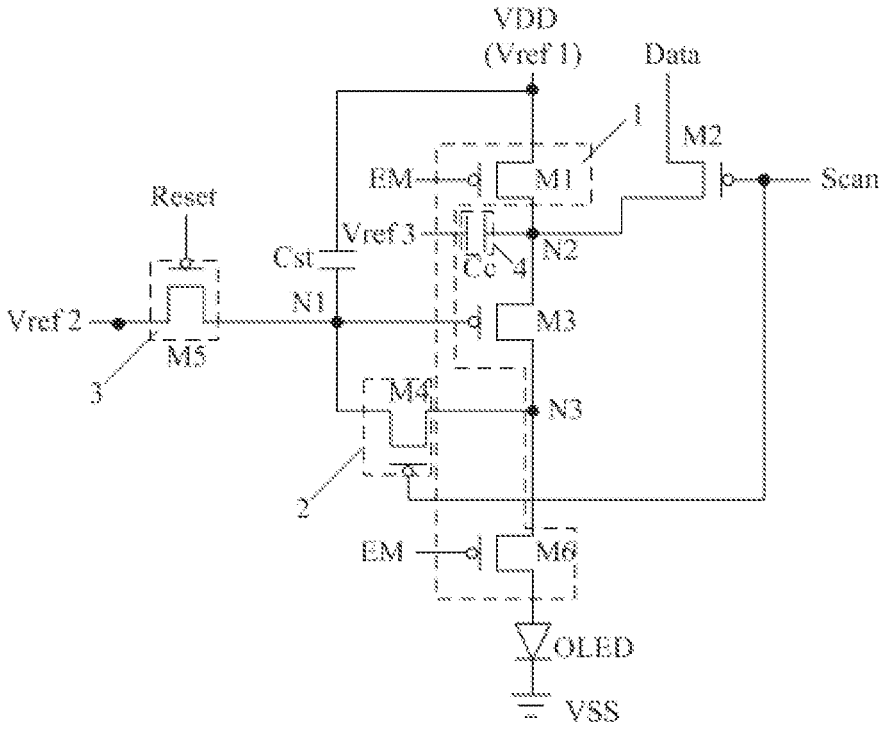
FIG. 3 is a schematic diagram showing a structure of a pixel circuit according to an embodiment of the disclosure.

As shown in FIG. 3, in the pixel circuit of the present embodiment, the reset unit 3 transmits an initialization signal provided from an initialization signal terminal Vref2 to a node N1 under the control of a reset control signal provided from a reset signal terminal Reset. The node N1 is a coupling node at which the reset unit 3, the first terminal of the storage capacitor Cst, and the control electrode of the driving transistor M3 are coupled.

Specifically, the reset unit 3 may include a reset transistor M5. A source of the reset transistor M5 is coupled to the initialization signal terminal Vref2, a drain of the reset transistor M5 is coupled to the node N1, and a gate of the reset transistor M5 is coupled to the reset signal terminal Reset. The reset signal terminal Reset provides the reset control signal. The initialization signal terminal Vref2 provides the initialization signal. Of course, the reset unit 3 is not limited to including only the reset transistor M5.

In the pixel circuit of the present embodiment, the threshold voltage extraction unit 2 may include a threshold voltage extraction transistor M4. A source of the threshold voltage extraction transistor M4 is coupled to the node N1, a drain of the threshold voltage extraction transistor M4 is coupled to a node N3, and a gate of the threshold voltage extraction transistor M4 is coupled to the scan line Scan. The node N3 is a coupling node at which the drain of the driving transistor M3 and the first electrode of the light emitting device OLED are coupled. The scan line Scan provides the scan signal.

In the pixel circuit of the present embodiment, the light emission control unit 1 may include a first light emission control transistor M1. A source of the first light emission control transistor M1 is coupled to the second power voltage terminal VDD, a drain of the first light emission control transistor M1 is coupled to a node N2, and a gate of the first light emission control transistor M1 is coupled to the light emission control signal terminal EM. The light emission control signal terminal EM supplies the light emission control signal. The light emission control unit 1 may further include a second light emission control transistor M6. A source of the second light emission control transistor M6 is coupled to the node N3, and a drain of the second light emission control transistor M6 is coupled to the first electrode of the light emitting device OLED. The second electrode of the light emitting device OLED is coupled to the first power voltage terminal VSS.

In the pixel circuit of the present embodiment, the second terminal of the storage capacitor Cst may be directly coupled to the second power voltage terminal VDD, and the second power voltage terminal VDD provides the second power voltage, that is, the second power voltage terminal VDD is used as the reference voltage terminal Vref1, i.e., the second power voltage may be used as a reference voltage, so as to reduce the number of signal ports of the pixel circuit.

In the pixel circuit of the present embodiment, the source of the switching transistor M2 is coupled to the data line Data, the drain of the switching transistor M2 is coupled to the node N2, and the gate of the switching transistor M2 is coupled to the scan line Scan. The node N2 is a coupling node for coupling the first terminal of the compensation unit 4, the source of the driving transistor M3, and the light emission control unit 1 with each other. The data line Data provides a data voltage signal. The scan line Scan supplies the scan signal.

In the pixel circuit of the present embodiment, the source of the driving transistor M3 is coupled to the node N2, the drain of the driving transistor M3 is coupled to the node N3, and the gate of the driving transistor M3 is coupled to the node N1. The node N1 is a coupling node for coupling the first terminal of the storage capacitor Cst with the threshold voltage extraction unit 2, The node N2 is a coupling node for coupling the light emission control unit 1, the first terminal of the compensation unit 4, and the drain of the switching transistor M2 with each other. The node N3 is a coupling node for coupling the threshold voltage extraction unit 2 with the first electrode of the light emitting device OLED.

Figure 4:
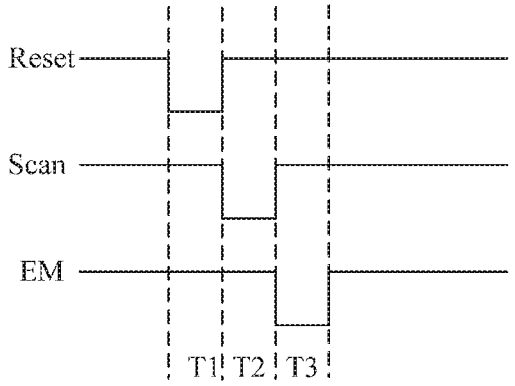
FIG. 4 is an operation timing diagram of a pixel circuit according to an embodiment of the disclosure.

In order to make the implementation of the pixel circuit in the present embodiment more clear, an operation process of the pixel circuit described above will be described below with reference to FIGS. 3 and 4.

In a stage T1, i.e., in an initialization stage, a reset control signal, which is a low level signal, is written to the reset signal terminal Reset, so that the reset transistor M5 is turned on, and the initialization signal written from the initialization signal terminal Vref2 resets the node N1 through the reset transistor M5.

In a stage T2, i.e., in a data writing and threshold voltage extraction stage, the scan signal, which is a low level signal, is written to the scan line Scan, so that the switching transistor M2 and the threshold voltage extraction transistor M4 are turned on, and the data voltage signal written into the data line Data is written to the node N2. Due to the feedthrough effect of the switching transistor M2, the voltage of the node N2 is a sum of the data voltage and the feedthrough voltage ($V_{data}+V_{feedthrough}$); while due to the turned-on of the threshold voltage extraction transistor M4, a voltage of the N3 node is equal to a voltage of the node N1, and the voltage of the node N1 is $V_{data}+V_{feedthrough}-V_{th}$.

In a stage T3, that is, in a light emitting stage, a light emitting control signal, which is a low level signal, is written to the light emission control signal terminal EM, so that the first light emission control transistor M1 and the second light emission control transistor M6 are turned on, and at this time, the voltage of the node N2 is the second power voltage provided by the second power voltage terminal VDU, and since the voltage of the node N1 is $V_{data}+V_{feedthrough}-V_{th}$, a current for driving the light emitting device OLED to emit light is $I_{ds}$, and $I_{ds}$ is calculated according to the following formula.

$$I_{ds} = K \times (V_{gs} - V_{th})^2 = K \times (N2 - N1 - V_{th})^2 = K \times (Vdd - V_{data} - V_{feedthrough} + |V_{th}| - |V_{th}|)^2 = K \times (Vdd - V_{data} - V_{feedthrough})^2$$

K为 1/2×Cox×W/L×mobility, and in the present example, K is a constant value.

The feedthrough voltage of the switching transistor M2 in the pixel circuit shown in FIG. 1 can be calculated according to the feedthrough voltage calculation formula as follows.

$$V_{feedthrough} = \frac{\frac{1}{2} \times W \times L \times C_{ox}(V_{GH} - V_{TH}) + C_{gdM2}(V_{GH} - V_{GL})}{C_{gdM1} + C_{gdM2} + C_{gdM6} + Cst}$$

Where $C_{ox}$, is a capacitance per unit area of the gate insulating layer of the switching transistor M2, $V_{GH}$ is a voltage value of the scan signal when the scan signal is at a high level, $V_{GL}$ is a voltage value of the scan signal when the scan signal is at a low level, $V_{TH}$ is the threshold voltage of the switching transistor M2, W is a channel width of the switching transistor M2, L is a channel length of the switching transistor M2, $C_{gdM1}$ is a gate-drain parasitic capacitance of the first light emission control transistor M1, $C_{gdM2}$ is a gate-drain parasitic capacitance of the switching transistor M2, $C_{gdM6}$ is a gate-drain parasitic capacitance of the second light emission control transistor M6, and Cst is a capacitance value of the storage capacitor Cst.

In the present embodiment, since the compensation capacitor Cc is added, the feedthrough voltage of the switching transistor M2 can be calculated by the following calculation formula.

$$V_{feedthrough} = \frac{\frac{1}{2} \times W \times L \times C_{ox}(V_{GH} - V_{TH}) + C_{gdM2}(V_{GH} - V_{GL})}{C_{gdM1} + C_{gdM2} + C_{gdM6} + Cst + Cc}$$

Where Cc is a capacitance value of the compensation capacitor Cc.

It can be seen that the feedthrough voltage of the switching transistor M2 in the present embodiment is significantly reduced due to the addition of the compensation capacitor Cc. Therefore, in the display panel to which the pixel circuit of the present embodiment is applied, the feedthrough voltage of the switching transistor M2 in each pixel circuit is reduced, so that the difference between the feedthrough voltages of the switching transistors M2 at different positions can be greatly reduced, and the problem of non-uniform display of the display panel can be effectively improved.

Figure 5:
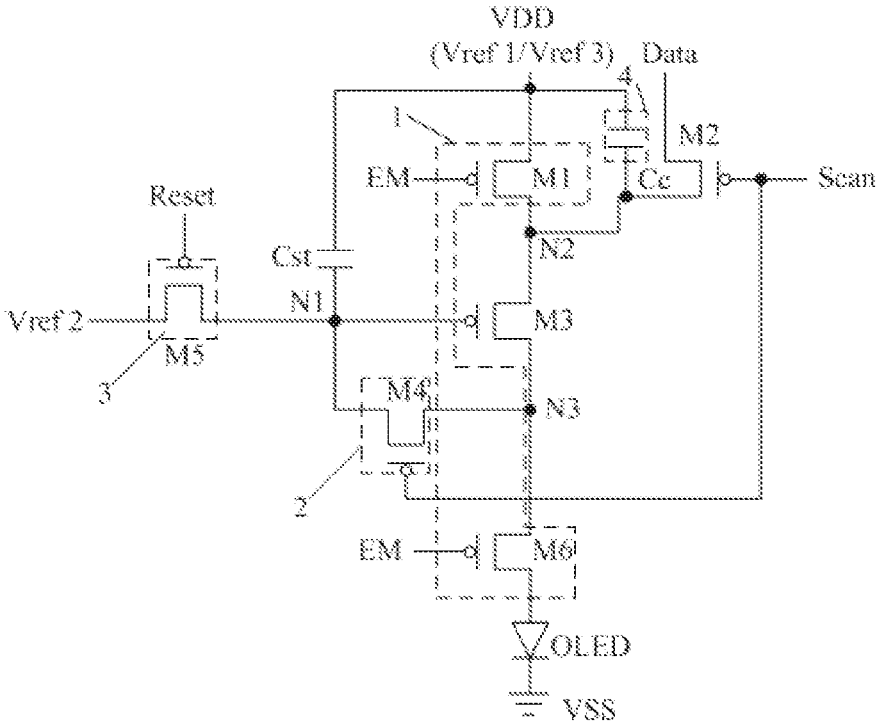
FIG. 5 is a schematic diagram showing a structure of a pixel circuit according to an embodiment of the disclosure.

An embodiment of the present disclosure further provides a pixel circuit, as shown in FIG. 5, including a light emitting device OLED, a light emission control unit 1, a threshold voltage extraction unit 2, a reset unit 3, a switching transistor M2, a driving transistor M3, a storage capacitor Cst, and a compensation unit 4. The light emission control unit 1 includes a first light emission control transistor M1 and a second light emission control transistor M6. The threshold voltage extraction unit 2 includes a threshold voltage extraction transistor M4. The reset unit 3 includes a reset transistor M5. The compensation unit 4 includes a compensation capacitor Cc.

Specifically, as shown in FIG. 5, a source of the switching transistor M2 is coupled to a data line Data, a drain of the switching transistor M2 is coupled to a node N2, and a gate of the switching transistor M2 is coupled to a scan line Scan. A source of the driving transistor M3 is coupled to the node N2, a drain of the driving transistor M3 is coupled to a node N3, and a gate of the driving transistor M3 is coupled to a node N1. In the light emission control unit 1, a source of the first light emission control transistor M1 is coupled to a second power voltage terminal VDD, a drain of the first light emission control transistor M1 is coupled to the node N2, and a gate of the first light emission control transistor M1 is coupled to a light emission control signal terminal EM. A source of the second light emission control transistor M6 is coupled to the node N3, a drain of the second light emission control transistor M6 is coupled to a first electrode of the light emitting device OLED, and a gate of the second light emission control transistor M6 is coupled to the light emission control signal terminal EM. A second electrode of the light emitting device OLED is coupled to a first power voltage terminal VSS. A source of the threshold voltage extraction transistor M4 is coupled to the node N1, a drain of the threshold voltage extraction transistor M4 is coupled to the node N3, and a gate of the threshold voltage extraction transistor M4 is coupled to a scan line Scan. A source of the reset transistor M5 is coupled to an initialization signal terminal Vref2, a drain of the reset transistor M5 is coupled to the node N1, and a gate of the reset transistor M5 is coupled to a reset signal terminal Reset. A first terminal of compensation capacitor Cc is coupled to the node N2, and a second terminal of compensation capacitor Cc is coupled to the second power voltage terminal VDD. At this time, the second power voltage terminal VDD is also used as a compensation voltage terminal Vref3. That is, in the present embodiment, a second power voltage written by the second power voltage terminal VDD is used as a compensation voltage.

An operation process of the pixel circuit described above will be described with reference to FIG. 4.

In a stage T1, i.e., in an initialization stage, a reset control signal, which is a low level signal, is written to the reset signal terminal Reset, so that the reset transistor M5 is turned on, and an initialization signal written from the initialization signal terminal Vref2 resets the node N1 through the reset transistor M5.

In a stage T2, i.e., in a data writing and threshold voltage extraction stage, a scan signal, which is a low level signal, is written to the scan line Scan, so that the switching transistor M2 and the threshold voltage extraction transistor M4 are turned on, and at this time, a data voltage signal written to the data line Data is written to the node N2. Due to the feedthrough effect of the switching transistor M2, a voltage of the node N2 is a sum of a data voltage and the feedthrough voltage ($V_{data}+V_{feedthrough}$), and due to turned-on of the threshold voltage extraction transistor M4, a voltage of the node N3 is equal to a voltage of the node N1, and the voltage of the node N1 is $V_{data}+V_{feedthrough}-V_{th}$.

In a stage T3, i.e., in a light emitting stage, a light emission control signal, which is a low level signal, is written to the light emission control signal terminal EM, so that the first light emission control transistor M1 and the second light emission control transistor M6 are turned on, at this time, the voltage of the node N2 is the second power voltage VDD, and since the voltage of the node N1 is $V_{data}+V_{feedthrough}-V_{th}$, a current for driving the light emitting device OLED to emit light is $I_{ds}$, and $I_{ds}$, is calculated according to the following formula.

$$I_{ds} = K \times (V_{gs} - V_{th})^2 = K \times (N2 - N1 - V_{th})^2 = K \times (Vdd - V_{data} - V_{feedthrough} + |V_{th}| - |V_{th}|)^2 = K \times (Vdd - V_{data} - V_{feedthrough})^2$$

K 为 1/2×Cox×W/L×mobility, in the present example, K is a constant value.

The feedthrough voltage of the switching transistor M2 in the pixel circuit shown in FIG. 1 can be calculated according to the feedthrough voltage calculation formula as follows.

$$V_{feedthrough} = \frac{\frac{1}{2} \times W \times L \times C_{ox}(V_{GH} - V_{TH}) + C_{gdM2}(V_{GH} - V_{GL})}{C_{gdM1} + C_{gdM2} + C_{gdM6} + Cst}$$

Where Cox is an capacitance per unit area of the gate insulating layer of the switching transistor M2, $V_{GH}$ is a voltage value of the scan signal when the scan signal is at a high level, $V_{GL}$ is a voltage value of the scan signal when the scan signal is at a low level, $V_{TH}$ is the threshold voltage of the switching transistor M2, W is a channel width of the switching transistor M2, L is a channel length of the switching transistor M2, $C_{gdM1}$ is a gate-drain parasitic capacitance of the first light emission control transistor M1, $C_{gdM2}$ is a gate-drain parasitic capacitance of the switching transistor M2, $C_{gdM6}$ is a gate-drain parasitic capacitance of the second light emission control transistor M6, and Cst is a capacitance value of the storage capacitor Cst.

In the present embodiment, since the compensation capacitor Cc is added, the feedthrough voltage of the switching transistor M2 can be calculated by the following calculation formula.

$$V_{feedthrough} = \frac{\frac{1}{2} \times W \times L \times C_{ox}(V_{GH} - V_{TH}) + C_{gdM2}(V_{GH} - V_{GL})}{C_{gdM1} + C_{gdM2} + C_{gdM6} + Cst + Cc}$$

Where Cc is a capacitance value of the compensation capacitor Cc.

It can be seen that, since the compensation capacitor Cc is added, the feedthrough voltage of the switching transistor M2 in the present embodiment is significantly reduced, and therefore, in the display panel to which the pixel circuit of the present embodiment is applied, since the feedthrough voltage of the switching transistor M2 in each pixel circuit is reduced, the difference between feedthrough voltages of the switching transistors M2 at different positions can be greatly reduced, and the problem of non-uniform display of the display panel can be effectively improved.

Figure 6:
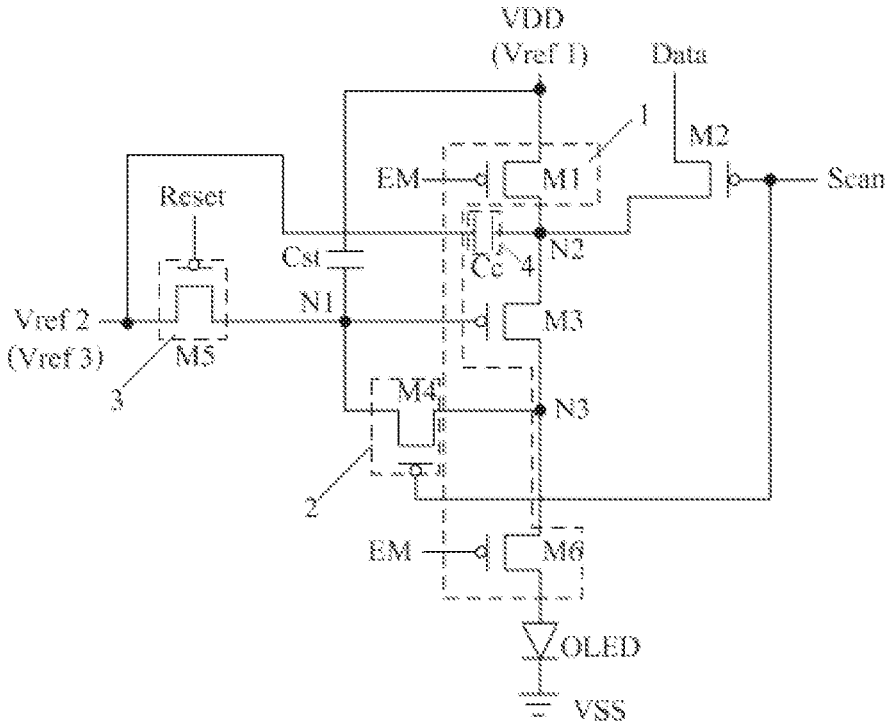
FIG. 6 is a schematic diagram showing a structure of a pixel circuit according to an embodiment of the disclosure.

An embodiment of the present disclosure also provides a pixel circuit, as shown in FIG. 6, which also includes a light emitting device OLED, a light emission control unit 1, a threshold voltage extraction unit 2, a reset unit 3, a switching transistor M2, a driving transistor M3, a storage capacitor Cst, and a compensation unit 4. The light emission control unit 1 includes a first light emission control transistor M1 and a second light emission control transistor M6. The threshold voltage extraction unit 2 includes a threshold voltage extraction transistor M4. The reset unit 3 includes a reset transistor M5. The compensation unit 4 includes a compensation capacitor Cc. In the present embodiment, as shown in FIG. 6, a first terminal of the compensation capacitor Cc is coupled to a node N2, a second terminal of the compensation capacitor Cc is coupled to an initialization signal terminal Vref2, and at this time, the initialization signal terminal Vref2 is also used as a compensation voltage terminal Vref3. That is, in the present embodiment, an initialization signal written into a source of the reset transistor M5 is used as a compensation voltage.

Figure 7:
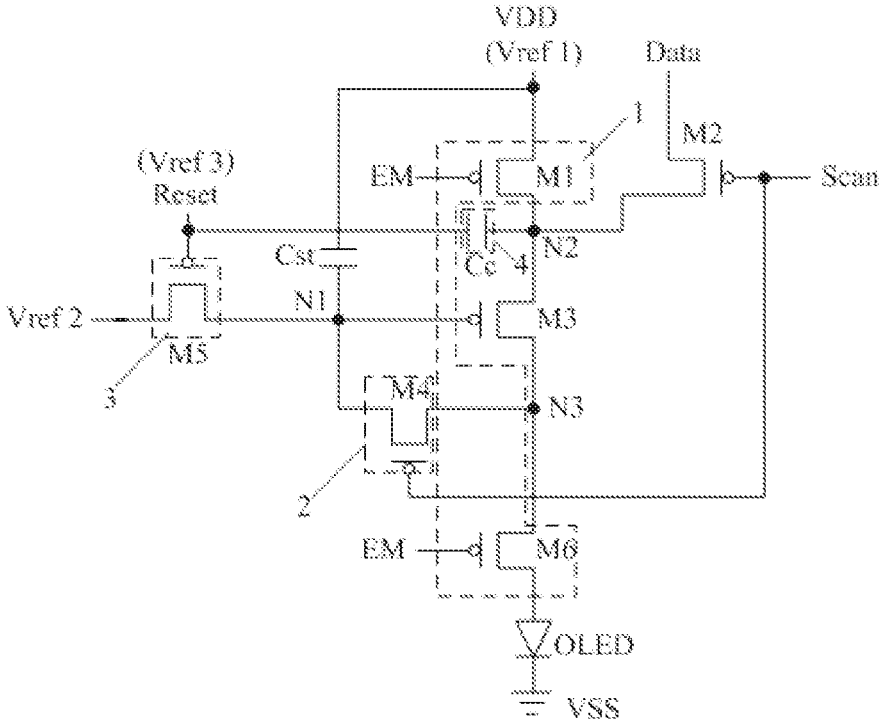
FIG. 7 is a schematic diagram showing a structure of a pixel circuit according to an embodiment of the disclosure.

An embodiment of the present disclosure also provides a pixel circuit, as shown in FIG. 7, which also includes a light emitting device OLED, a light emission control unit 1, a threshold voltage extraction unit 2, a reset unit 3, a switching transistor M2, a driving transistor M3, a storage capacitor Cst, and a compensation unit 4. The light emission control unit 1 includes a first light emission control transistor M1 and a second light emission control transistor M6. The threshold voltage extraction unit 2 includes a threshold voltage extraction transistor M4. The reset unit 3 includes a reset transistor M5. The compensation unit 4 includes a compensation capacitor Cc. In this embodiment, as shown in FIG. 7, a first terminal of the compensation capacitor Cc is coupled to a node N2, a second terminal of the compensation capacitor Cc is coupled to a gate of the reset transistor M5. Since the gate of the reset transistor M5 is coupled to the reset signal terminal Reset, at this time, the reset signal terminal Reset is also used as a compensation voltage terminal Vref3. That is, in the present embodiment, a reset control signal written to the gate of the reset transistor M5 is used as a compensation voltage.

In fact, in the pixel circuit of the embodiment of the present disclosure, the first terminal of the compensation capacitor Cc included in the compensation unit 4 is coupled to the node N2 (i.e., the drain of the switching transistor M2), and the second terminal of the compensation capacitor Cc only needs to be coupled to a terminal or a line that supplies a constant voltage during a period (including T2 and T3) from a timing when the switching transistor M2 starts to be turned on to a timing when the display of the current frame ends.

An embodiment of the present disclosure also provides a display device including any one of the pixel circuits provided by the embodiments of the present disclosure.

The display device in this embodiment may include any product or component having a display function, such as an OLED display panel, a mobile phone, a tablet computer, a television, a display, a notebook computer, a digital photo frame, and a navigator.

Since the display device of the present embodiment includes the pixel circuit of the embodiment of the disclosure, the uniformity of the image displayed by the display device is greatly improved.

It is to be understood that the above embodiments are merely exemplary embodiments employed for illustrating the principles of the technical solutions of the present disclosure, and the present disclosure is not limited thereto. It will be apparent to those skilled in the art that various changes and modifications can be made therein without departing from the spirit of the disclosure, and these changes and modifications should also be construed as falling within the scope of the disclosure.

What is claimed is:

1. A pixel circuit, comprising a switching transistor, a driving transistor, a storage capacitor, a threshold voltage extraction unit, a light emission control unit, a light emitting device, and a compensation unit, wherein the light emitting device has a first electrode coupled to a second electrode of the driving transistor and a second electrode receiving a first power voltage, a first terminal of the storage capacitor is coupled to a control electrode of the driving transistor, and a second terminal of the storage capacitor is coupled to a reference voltage terminal, the switching transistor is configured to transmit a data voltage signal to a first electrode of the driving transistor under the control of a scan signal, the threshold voltage extracting unit is configured to couple the control electrode of the driving transistor to the second electrode of the driving transistor under the control of the scan signal, the light emission control unit is configured to transmit a second power voltage to the first electrode of the driving transistor under the control of a light emission control signal, and the compensation unit is configured to transmit a compensation voltage to a second electrode of the switching transistor to reduce a feedthrough voltage of the switching transistor, wherein the compensation unit comprises a compensation capacitor, a first terminal of the compensation capacitor is coupled to the second electrode of the switching transistor, a second terminal of the compensation capacitor is coupled to a compensation voltage terminal, and the compensation voltage terminal provides the compensation voltage.

2. The pixel circuit according to claim 1, further comprising a reset unit configured to transmit an initialization signal to the control electrode of the driving transistor under the control of a reset control signal.

3. The pixel circuit according to claim 2, wherein the reset unit comprises a reset transistor, wherein a first electrode of the reset transistor is coupled to an initialization signal terminal, a second electrode of the reset transistor is coupled to the control electrode of the driving transistor, a control electrode of the reset transistor is coupled to a reset signal terminal, the initialization signal terminal provides the initialization signal, and the reset signal terminal provides the reset control signal.

4. The pixel circuit according to claim 3, wherein the first terminal of the compensation capacitor is coupled to the second electrode of the switching transistor and the first electrode of the driving transistor, the second terminal of the compensation capacitor is coupled to the initialization signal terminal, and the initialization signal terminal is used as the compensation voltage terminal.

5. The pixel circuit according to claim 3, wherein the first terminal of the compensation capacitor is coupled to the second electrode of the switching transistor and the first electrode of the driving transistor, the second terminal of the compensation capacitor is coupled to the reset signal terminal, and the reset signal terminal is used as the compensation voltage terminal.

6. The pixel circuit according to claim 3, wherein the light emission control unit further comprises a second light emission control transistor, wherein, a first electrode of the second light emission control transistor is coupled to the threshold voltage extraction unit and the second electrode of the driving transistor, a second electrode of the second light emission control transistor is coupled to the first electrode of the light emitting device, and a control electrode of the second light emission control transistor is coupled to the light emission control signal terminal.

7. The pixel circuit according to claim 6, wherein the threshold voltage extraction unit comprises a threshold voltage extraction transistor, wherein a first electrode of the threshold voltage extraction transistor is coupled to the first terminal of the storage capacitor and the control electrode of the driving transistor, a second electrode of the threshold voltage extraction transistor is coupled to the second electrode of the driving transistor and the first electrode of the light emitting device, a control electrode of the threshold voltage extraction transistor is coupled to a scan line, and the scan line provides the scan signal.

8. The pixel circuit according to claim 7, wherein the first terminal of the storage capacitor is coupled to the control electrode of the driving transistor and the threshold voltage extraction unit, and the second terminal of the storage capacitor is coupled to a second power voltage terminal which supplies the second power voltage and is common to the reference voltage terminal.

9. The pixel circuit according to claim 8, wherein a first electrode of the switching transistor is coupled to a data line, the second electrode of the switching transistor is coupled to a first terminal of the compensation unit, the first electrode of the driving transistor and the light emission control unit, a control electrode of the switching transistor is coupled to a scan line, the data line provides the data voltage signal, and the scan line provides the scan signal.

10. The pixel circuit according to claim 9, wherein the first electrode of the driving transistor is coupled to the light emission control unit, a first terminal of the compensation unit and the second electrode of the switching transistor, the second electrode of the driving transistor is coupled to the threshold voltage extraction unit and the first electrode of the light emitting device, and the control electrode of the driving transistor is coupled to the first terminal of the storage capacitor and the threshold voltage extraction unit.

11. A display device comprising the pixel circuit according to claim 2.

12. The pixel circuit according to claim 1, wherein the light emission control unit comprises a first light emission control transistor, wherein a first electrode of the first light emission control transistor is coupled to a second power voltage terminal, a second electrode of the first light emission control transistor is coupled to the second electrode of the switching transistor, the first electrode of the driving transistor and the first terminal of the compensation capacitor, a control electrode of the first light emission control transistor is coupled to a light emission control signal terminal, and the light emission control signal terminal provides the light emission control signal.

13. The pixel circuit according to claim 12, wherein the first terminal of the compensation capacitor is coupled to the second electrode of the switching transistor, the second terminal of the compensation capacitor is coupled to the second power voltage terminal, and the second power voltage terminal provides the second power voltage and is common to the compensation voltage terminal.

14. The pixel circuit according to claim 12, wherein the light emission control unit further comprises a second light emission control transistor, wherein, a first electrode of the second light emission control transistor is coupled to the threshold voltage extraction unit and the second electrode of the driving transistor, a second electrode of the second light emission control transistor is coupled to the first electrode of the light emitting device, and a control electrode of the second light emission control transistor is coupled to the light emission control signal terminal.

15. The pixel circuit according to claim 1, wherein the threshold voltage extraction unit comprises a threshold voltage extraction transistor, wherein a first electrode of the threshold voltage extraction transistor is coupled to the first terminal of the storage capacitor and the control electrode of the driving transistor, a second electrode of the threshold voltage extraction transistor is coupled to the second electrode of the driving transistor and the first electrode of the light emitting device, a control electrode of the threshold voltage extraction transistor is coupled to a scan line, and the scan line provides the scan signal.

16. The pixel circuit according to claim 1, wherein the first terminal of the storage capacitor is coupled to the control electrode of the driving transistor and the threshold voltage extraction unit, and the second terminal of the storage capacitor is coupled to a second power voltage terminal which supplies the second power voltage and is common to the reference voltage terminal.

17. The pixel circuit according to claim 1, wherein a first electrode of the switching transistor is coupled to a data line, the second electrode of the switching transistor is coupled to a first terminal of the compensation unit, the first electrode of the driving transistor and the light emission control unit, a control electrode of the switching transistor is coupled to a scan line, the data line provides the data voltage signal, and the scan line provides the scan signal.

18. The pixel circuit according to claim 1, wherein the first electrode of the driving transistor is coupled to the light emission control unit, a first terminal of the compensation unit and the second electrode of the switching transistor, the second electrode of the driving transistor is coupled to the threshold voltage extraction unit and the first electrode of the light emitting device, and the control electrode of the driving transistor is coupled to the first terminal of the storage capacitor and the threshold voltage extraction unit.

19. A display device comprising the pixel circuit according to claim 1.

* * * * *